US005304010A

United States Patent [19]

Hsing-San

[11] Patent Number: 5,304,010

[45] Date of Patent: Apr. 19, 1994

[54] TOOTHBRUSH WITH AUTOMATIC WATER SUPPLY

[76] Inventor: Chu Hsing-San, 2F. No. 5, Lane 38, Sec. 2, Pao-Yuan Road, Shin-Diann City, Taiwan

[21] Appl. No.: 52,148

[22] Filed: Apr. 23, 1993

[51] Int. Cl.[5] ..... A46B 11/06

[52] U.S. Cl. ..... 401/289; 401/204; 401/291; 401/280; 251/205; 251/144.7

[58] Field of Search ..... 401/203, 204, 280, 287, 401/286, 284, 290, 291; 251/205, 319, 149.1, 149.7

[56] References Cited

U.S. PATENT DOCUMENTS

| | | | |
|---|---|---|---|
| 1,241,352 | 9/1917 | Doering et al. | 251/149.7 |
| 2,855,619 | 10/1958 | Graham | 401/289 X |
| 2,937,656 | 5/1960 | Evans et al. | 251/205 X |
| 4,580,588 | 4/1986 | Swope | 401/290 X |
| 4,863,302 | 9/1989 | Herzfeld et al. | 401/290 X |

FOREIGN PATENT DOCUMENTS

| | | | |
|---|---|---|---|
| 1257061 | 7/1989 | Canada | 401/280 |
| 1941645 | 2/1971 | Fed. Rep. of Germany | 251/149.7 |
| 1009187 | 2/1952 | France | 401/289 |

*Primary Examiner*—Danton D. DeMille

*Attorney, Agent, or Firm*—Pro-Techtor International

[57] ABSTRACT

A device of toothbrush capable of automatic supplying with water, which comprises a hollow body being of suitable size and length, the body is provided with a water inlet at one end thereof; a water controller being provided near the middle position of the body to control the flowing of water toward a brush portion of the toothbrush at the front end thereof, when being controlled, clean water can be flushed upwardly from under said brush portion.

1 Claim, 4 Drawing Sheets

TOOTHBRUSH WITH AUTOMATIC WATER SUPPLY

BACKGROUND OF THE INVENTION

The present invention relates to a device of toothbrush capable of automatic supplying with water, and especially relates to one into which water can be fed from one end thereof, and flow through the hollow body of it having a flow control therein, and then spray from the brush portion.

The existing tools for cleaning teeth comprise among others mainly toothbrushes, generally teeth brushing is made by plastering a layer of toothpaste on the brush portion of a toothbrush, then brushing the teeth of a person to form bubles, and lastly being vomitted out with clean water from his mouth. Accordingly, clean water is necessary for teeth brushing.

A container such as tooth glass is traditionally used to fill in water, in use, a water faucet is turned on to let water inject into the glass, and after plastering and brushing the toothpaste on one's teeth, the water is drunk into his mouth, and then is vomitted out therefrom. The procedure including taking a glass, injecting water, drinking water etc. is relatively complicated and hence is inconvenient.

The conventional mode of flushing the inside of the mouth with water by the force of movement of the muscles of the face in the teeth brushing procedure is not ideal, it can not thoroughly clear the dirt such as toothpaste, toothpowder, residual foods inside the mouth and the dirt in every seam between teeth.

In consideration of sanitation, there are normally a plurality of tooth glasses for the members in a family, therefore, the bath room for them is crowed with the glasses on the shelf therein.

SUMMARY OF THE PRESENT INVENTION

The principal object of the present invention is to provide a device of toothbrush capable of automatic supplying with water, the shank of the toothbrush is made a hollow one, an inlet is provided at one end thereof for connecting with a connector, a water controller is provided near the middle position of it to control the flowing of water toward the brush portion of the toothbrush. A plurality of outlets are provided in the region of the brush portion, the clean water can be flushed upwardly from under the brush automatically when the controller is actuated, so that water can be supplied automatically without a container such as a tooth glass.

The novelty as well as other features of the present invention will be apparent in reading the specification thereof in referring to the accompanying drawings.

BRIEF DESCRIPTION OF THE DRAWINGS

Referring to FIG. 1, the present invention has generally a hollow body 10 for a toothbrush, being of suitable size and length for holding in hand, the body 10 is provided with a water inlet 11 at the rear end thereof, and with an assembled brush piece 12 at the other end thereof, also with a push button 13 for water controlling near the middle thereof.

A connector 90 is connected at its front end to the inlet end 11 of the body 10, and is connected to a faucet 91 at the other end.

Figure 2:
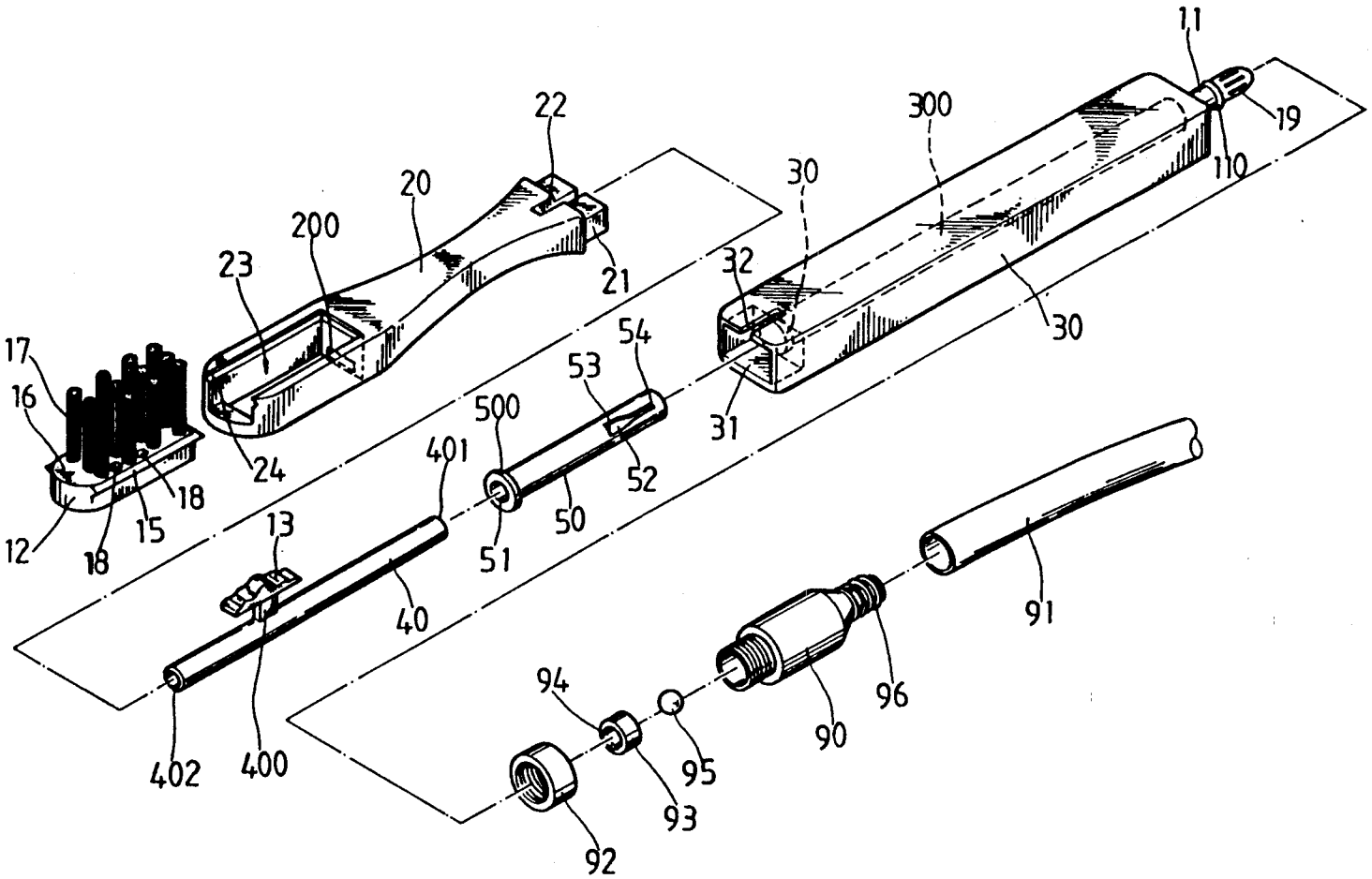
FIG. 2 is a detailed analytic drawing of the device of FIG. 1 showing the particular parts.

Referring also to FIG. 2, the body 10 in this preferred embodiment is composed of a front shank portion 20 and a rear shank portion 30. There is a diminuted portion 21 at the rear end of the front shank portion 20 for connecting with a front opening 31 on the rear shank portion 30, the portion 21 and the opening 31 each has a clamping groove 22, 32 facing with each other with suitable length.

The front shank portion 20 has an inner through hole 200, and also has a concaved space 23 at the front end thereof; a front opening is provided in the space 23, and an engaging groove 24 is provided near the top face of the shank portion 20 and on the inner wall of the space 23. The above mentioned brush piece 12 has a size coincident with that of the concaved space 23, and is provided with a surrounding tenon 15 matching with the engaging groove 24, the upper end face 16 thereof is provided with brushes 17 in lines and is provided with more than one outlets 18 at some suitable positions. The brush piece 12 is movably connected, hence it can have various types of brushes to be chosen.

The rear shank portion 30 has also a central hole 300, on the front end of which there is an enlarged hole 301 forming a shoulder, the end inlet 11 thereon is provided with a raised annular ring 110 with a plurality of separated axial slots 19 therebehind.

Within the hollow body 10 composed by the front shank portion 20 and the rear shank portion 30 there is a water controller, which is composed of an inner pipe 40 and an outer sleeve 50. The sleeve 50 can be inserted into the central hole 300 of the rear shank portion 30 and is provided with a central hole 51, a protruding annular portion 500 is provided at the front end thereof for abutting against and connecting with the above mentioned shoulder formed by the holes 300, 301; an axial water controlling slot 52 is provided on the pipe wall near the end of the sleeve 50 having different widths in the front end 53 and the rear end 54 thereof. While the inner pipe 40 having the similar diameter to that of the central hole 51 of the outer sleeve 50 can be inserted into the hole 51, a neck sheet portion 400 is provided at an appropriate position on the pipe body for providing thereupon with a water controlling push button 13. When the front and rear shank portions 20, 30 are assembled, the neck sheet portion 400 is clamped between the clamping grooves 22, 32 and is allowed to move left- and right-ward.

Figure 1:
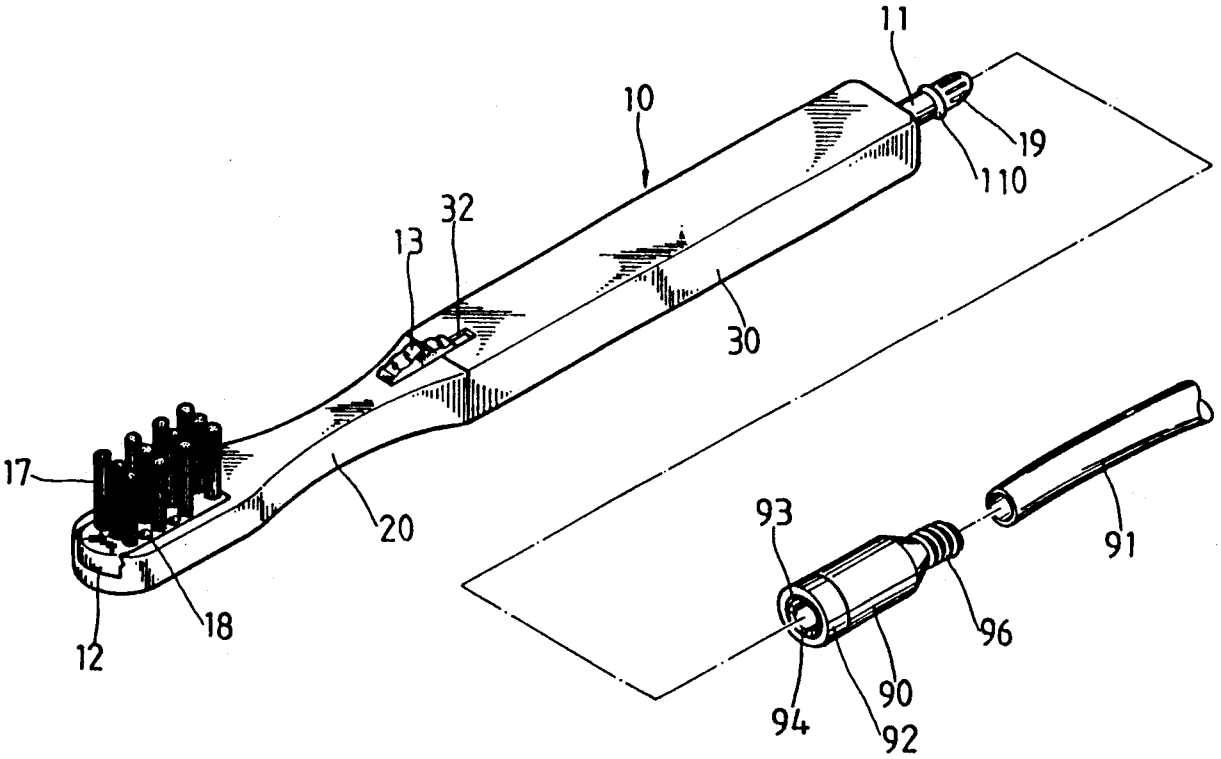
FIG. 1 is an analytic drawing of the present invention showing the water inlet of the toothbrush and a connector.

As shown in FIGS. 1 and 2, the present invention can be provided with a connector 90, which has a front end being connected to an end cap 92 in which a snug-up ring 93 is loaded, a ball 95 being larger than the opening 94 of the ring 93 is put thereon. At the end of the connector 90 there is a connecting end with a plurality of raised annular rings 96 for connecting with a hose 91.

Figure 3:
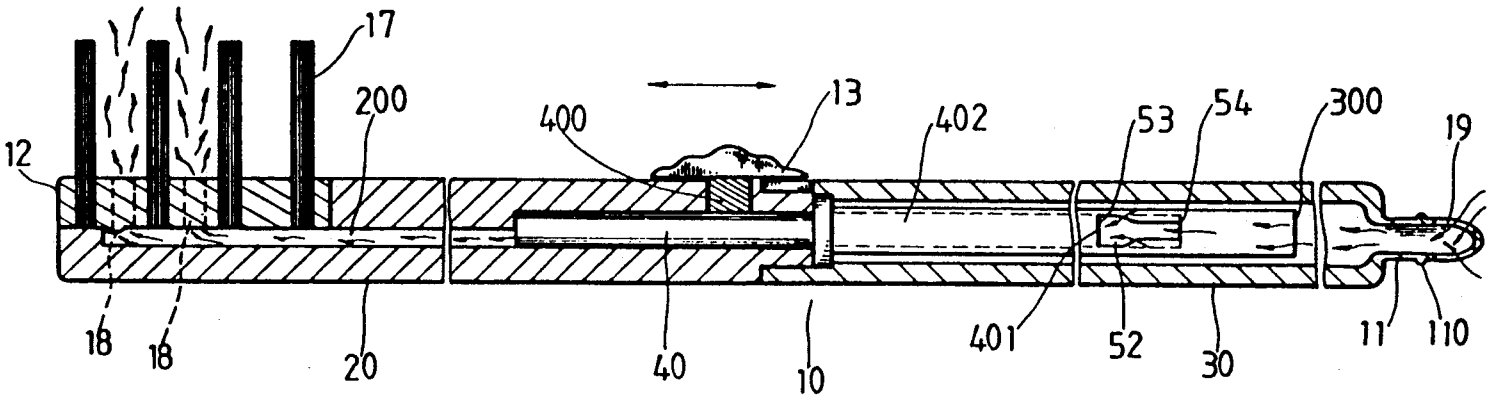
FIG. 3 is a vertical sectional view of the embodiment of FIG. 1 taken from a section line 3—3 therein, wherein the parts of the toothbrush being assembled.

As shown in FIG. 3, when the water controlling push button 13 is pushed left- and right-wardly in the directions as shown by an arrow therein, the inner pipe 40 thereunder will move synchronically with it. When the end portion 401 of the inner pipe 40 moves rightward as in the drawing and moves over thoroughly the position where the water controlling slot 52 is located, it will be in a turn off state of water; and when the end portion 401 moves leftward to the left-most end of the water controlling slot 52, the water flowing in can flow through the slot 52 and out of an inner hole 402 in the inner pipe 40. By this way, the water output can be determined by the movement of the inner pipe 40, i.e., when the end 401 of the inner pipe 40 moves to close to the rear end 54 of the slot 52 with a smaller width, the output will be smaller, and when close to the wider front end 53, the output will be larger.

Figure 4:
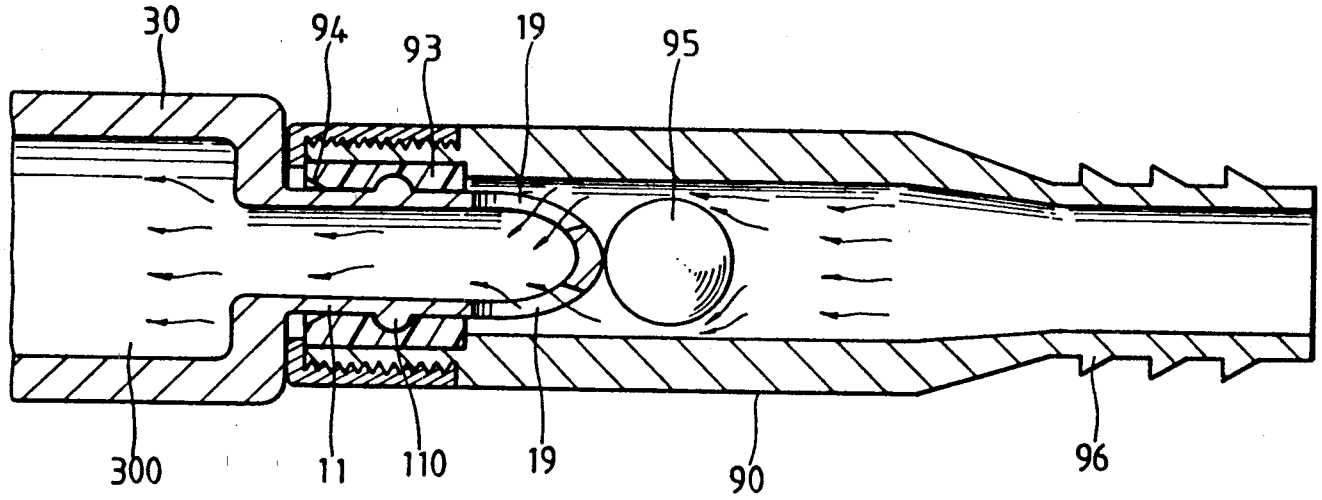
FIG. 4 is an enlarged vertical sectional view of the embodiment of FIG. 3 showing the connection between the connector and the water inlet at the rear end of the toothbrush.

Referring to FIG. 4, when the end inlet 11 is inserted into the connector 90, it will be located in the opening 94 of the snug-up ring 93, the annular ring 110 provided thereon can seal against water flow by snug conctacting with the inner wall of the snug-up ring 93, while the end of the inlet 11 can push away the ball 95 to let in water through the multiple axial slots 19 into the body 10 of the toothbrush. On the contrary, when the end inlet 11 and the connector 90 are separated, the ball 95 will press against am end opening of the snug-up ring 93 so as to prevent water from flow in.

When the body 10 and the connector 90 are assembled, the water controlling push button 13 can be moved left- or right-ward at any time to control the flow of water into the the body 10. While the push button 13 is in an turning on position, clean water can flush automatically from under the brushes 17 in a controlled output. A container such as a tooth glass can be saved, and the stronger and suitable output of water flow can have a more thorough flushing effect, the present invention hence is a practical device.

While various changes may be made in the detailed construction, it is understood that such changes will be within the spirit and scope of the present invention.

I claim:

1. A toothbrush with automatic water supply comprising:

a hollow body comprising a front shank portion and a rear shank portion, said hollow body being of suitable size and length to be hand-held, and said body including a water inlet at a first end thereof;

said hollow body further including a water controller near it midpoint to control water flow to a brush portion of said toothbrush so that clean water can be flushed upwardly through said brush portion;

said water controller comprising an inner pipe and an outer sleeve, said outer sleeve being inserted into a central hole of said rear shank portion, an axial water controlling slot being provided on the wall of said outer sleeve, said slot differing in width at a front end and a rear end thereof;

said inner pipe is inserted into said outer sleeve, a neck sheet portion being provided on said inner pipe for providing thereon a water controlling push button, said neck sheet portion being clamped between a plurality of clamping grooves provided on said front an rear shank portions, the end of said inner pipe being movable to different positions to control the flow of water.

* * * * *